US005947564A

United States Patent [19]

Chen

[11] Patent Number: 5,947,564

[45] Date of Patent: Sep. 7, 1999

[54] METHOD OF FORMING A RUFFLED CLEANING DEVICE

[75] Inventor: Kuo-Chin Chen, Taipei, Taiwan

[73] Assignee: Confirm Personal Care Industrial Corp., Taipei, Taiwan

[21] Appl. No.: 09/196,889

[22] Filed: Nov. 20, 1998

[51] Int. Cl.[6] ..... A47K 7/02

[52] U.S. Cl. ..... 300/21; 15/209.1; 15/229.11

[58] Field of Search ..... 15/208, 209.1, 15/210.1, 229.11; 300/21

[56] References Cited

U.S. PATENT DOCUMENTS

| | | | |
|---|---|---|---|
| 5,465,452 | 11/1995 | Girardot | 300/21 |
| 5,727,277 | 3/1998 | Chien | 300/21 |
| 5,727,278 | 3/1998 | Per-Lee | 300/21 |

*Primary Examiner*—Randall E. Chin

*Attorney, Agent, or Firm*—Pro-Techtor International Services

[57] ABSTRACT

Disclosed is a method for forming a ruffled cleaning device that includes a ruffled body connected to an inner ring in a manner facilitating convenient and effective body cleansing. The ruffled body is formed by axially ruffling at least two layers of elastic nets and tightening a center thereof to form a bow-shaped ruffled body having two through holes. The inner ring is flattened and threaded through the two holes of the ruffled body and tightened at two ends to interlock with the ruffled body. When the ruffled body is compressed against one end of the inner ring, ruffles on the ruffled body are more densely arranged and spread apart from an outer periphery thereof to form a scrubbing portion with increased contact area and elasticity to more effectively clean skin.

4 Claims, 11 Drawing Sheets

METHOD OF FORMING A RUFFLED CLEANING DEVICE

BACKGROUND OF THE INVENTION

The present invention relates to a method of forming a ruffled cleaning device, and more particularly to a method of forming a ruffled cleaning device having a ruffled body connected to an inner ring in a firmer manner to produce denser ruffles, better elasticity, and better massaging and cleaning effect.

U.S. Pat. No. 5,727,277 entitled "Body Washing Apparatus with Handle" discloses a ruffled cleaning means and the method for making the same. However, there are shortcomings existing in the manufacturing method of this patented body washing apparatus to cause undesired slack ruffles.

FIG. 1 is a perspective of a conventional ruffled cleaning device. As shown, the cleaning device mainly includes an inner ring 1 and a ruffled body 2. To make such conventional ruffled cleaning device, first axially compress an elastic net from two ends toward a middle portion thereof to form the ruffled body 2 having a central through hole 21. Then, axially turn over two ends of another elastic net toward a middle portion thereof to form the inner ring 1. The ring 1 is radially pulled into a double-layer strip for threading through the through hole 21 of the ruffled body 2. A string 11 or the like is used to tighten two ends of the strip together, so that the ruffled body 2 and the inner ring 1 interlock with one another. A portion of the ruffled body 2 contacting with the inner ring 1 serves as a base 22. Ruffles on the ruffled body 2 loosely spread apart from the base 22 to form a scrubbing portion 23 for washing and cleaning body areas. A portion of the inner ring 1 binding the base 22 of the ruffled body 2 serves as a bind 12, and portions of the inner ring 1 near the two tightened ends serves as a double-layer hand strap 13. A user may extend one hand through the hand strap 13 to hold the ruffled body 2, so that the scrubbing portion 23 may be easily handled to clean the body. A bar of soap may be selectively disposed between the base 22 and the hand strap 13 to produce bubbles.

To make the above conventional ruffled cleaning device, the inner ring 1 is first threaded through the hole 21 of the ruffled body 2 and then tightened at two ends with a string 11 in order to lock the ruffled body 2 in the ring 1. Following disadvantages are found in such connection manner:

1. The ruffled body 2 tends to too loosely spread apart from its base 22 and even becomes collapsed. The collapsed ruffles could not effectively remove dirt from skin.

2. The ruffled body 2 has not sufficient elasticity to massage skin while cleans it.

3. The slack and collapsed ruffled body 2 tends to irregularly shift in the inner ring 1 and cause inconvenience in use during cleaning.

4. The irregular shifting of the ruffled body 2 in the inner ring 1 causes largely reduced contact area of the scrubbing portion 23 with skin.

It is therefore desirable to develop a method of forming an improved ruffled cleaning device to eliminate the above-mentioned drawbacks existing in the conventional ruffled cleaning device.

SUMMARY OF THE INVENTION

A primary object of the present invention is to provide a method of forming a ruffled cleaning device that provides denser ruffles, better elasticity, and increased contact area to more effectively clean skin.

Another object of the present invention is to provide a method of forming a ruffled cleaning device that mainly includes a ruffled body connected to an inner ring in a firmer manner without moving irregularly relative to the inner ring when the cleaning device is used to scrub skin.

To achieve the above and other objects, the present invention mainly includes following steps:

Forming an inner ring by putting a long sleeve-shaped elastic net around a mold and axially turning over two ends of the net toward a middle portion thereof until the long sleeve becomes a ring on the mold, and then flattening the ring into a double-layer strip;

Forming a ruffled body by putting another long sleeve-shaped elastic nets around the mold and axially compressing two ends of the nets toward a middle portion thereof to produce ruffles along the mold;

Tying a middle point of the ruffled body with fastening means, so that a bow-shaped ruffled body having two through holes is formed;

Threading the strip of the flattened inner ring through the two holes of the bow-shaped ruffled body and tying up two ends of the strip with fastening means, so that the ruffled body and the inner ring interlock with each other; and Pushing the ruffled body against one end of the inner ring so that ruffles on the ruffled body become densely collected and spread apart at an outer periphery thereof to form a scrubbing portion of the ruffled cleaning device.

The ruffled cleaning device made by the method of the present invention has denser ruffles to provide better elasticity and increased contact area and can therefore more effectively clean skin while massaging it. The ruffled body is firmly connected to the inner ring without moving irregularly relative to the inner ring when the cleaning device is in use.

The ruffled body is formed from at least two layers of elastic nets. The outermost layer of the elastic nets is first axially ruffled toward the middle portion. An inner layer of the elastic nets is always axially and inward compressed for the produced ruffles to locate at two outer sides of the ruffles produced from an outer layer. This makes the ruffles denser to hold more bubbles.

The at least two layers of elastic nets for forming the ruffled body may be made of different materials or have different degrees of surface coarseness, so that only one single ruffled cleaning device would be enough for suitably cleaning different body areas.

BRIEF DESCRIPTION OF THE DRAWINGS

The objects, features, and performance of the present invention may be best understood by referring to the following detailed description of the preferred embodiments and the accompanying drawings, wherein.

DETAILED DESCRIPTION OF THE PREFERRED EMBODIMENTS

Figure 1:
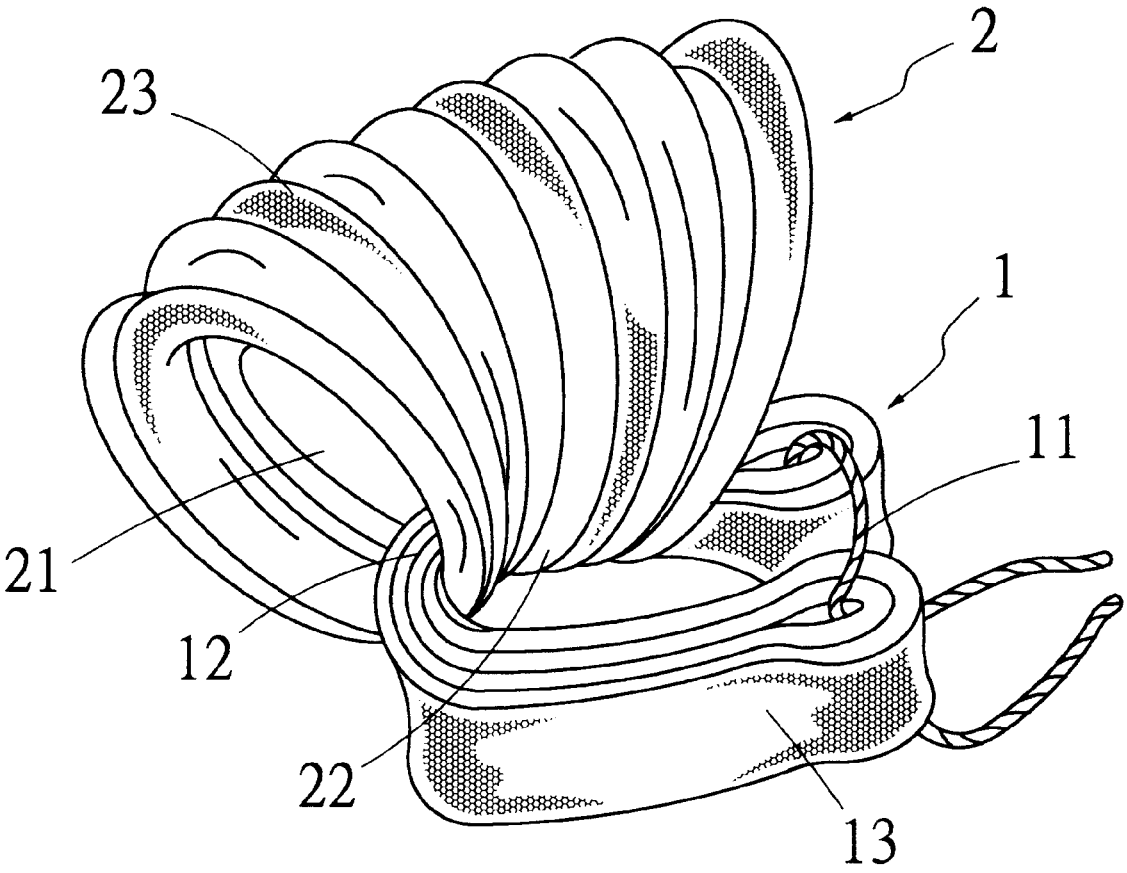
(PRIOR ART) Fig.1
FIG. 1 is a perspective of a conventional ruffled cleaning device.
Figure 2:
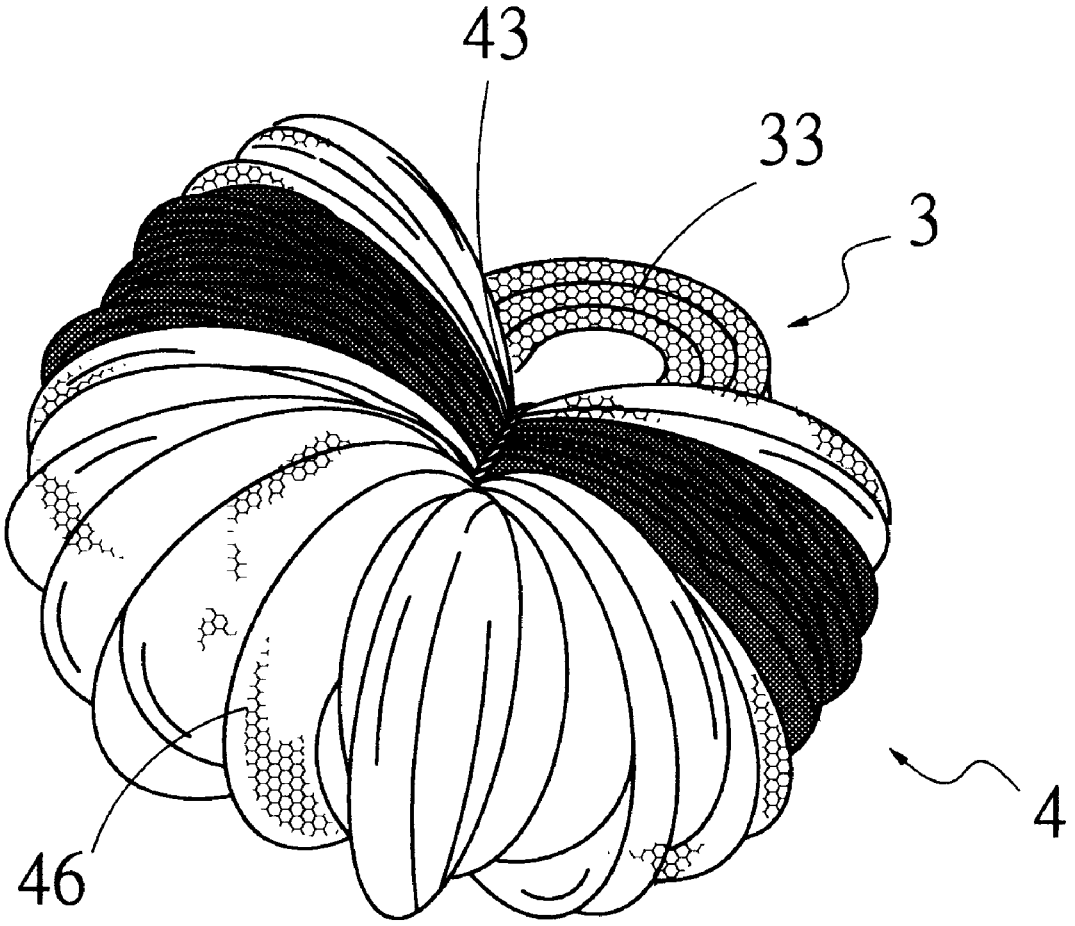
FIG. 2 is a perspective of a ruffled cleaning device made by the method of the present invention.
Figure 3:
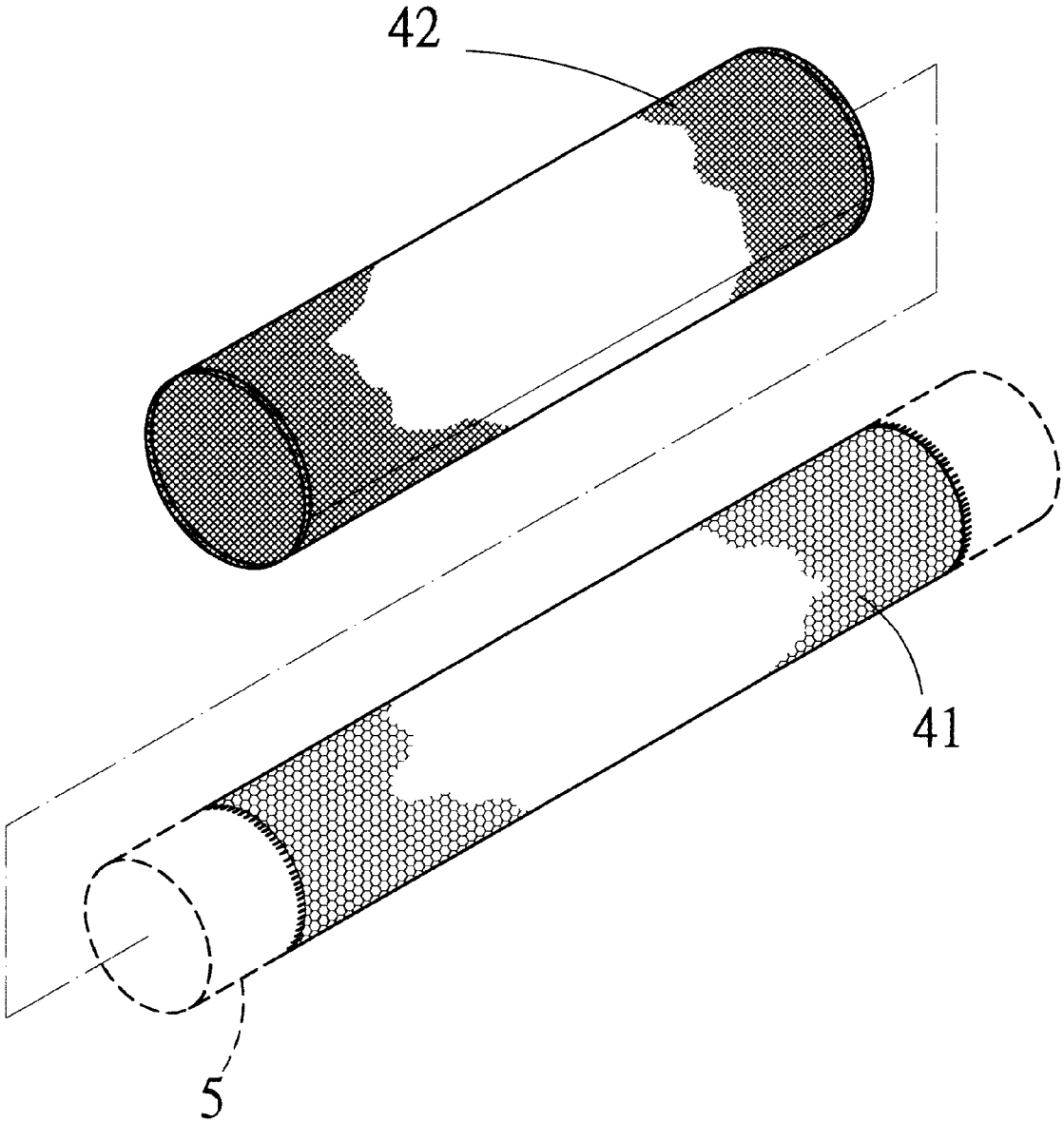
FIGS. 3 to 7 illustrate steps of the method of the present invention to form a bow-shaped ruffled body of the ruffled cleaning device of FIG. 2.
Figure 4:
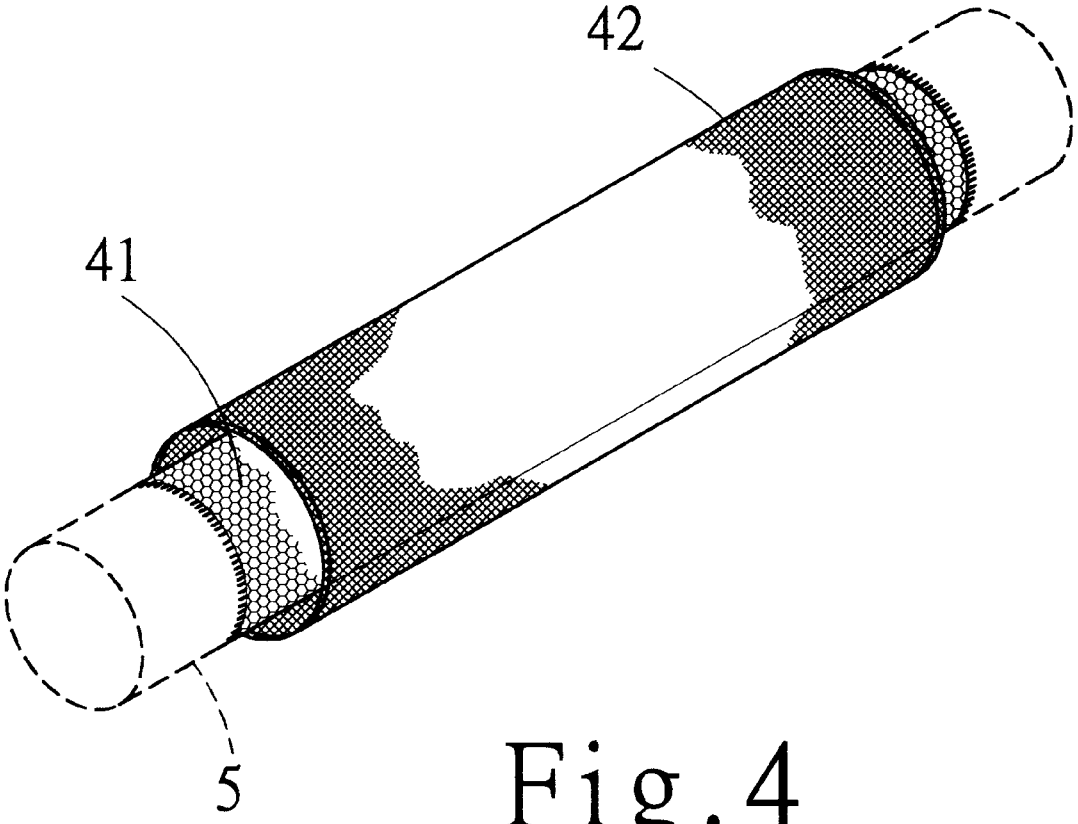
Figure 5:
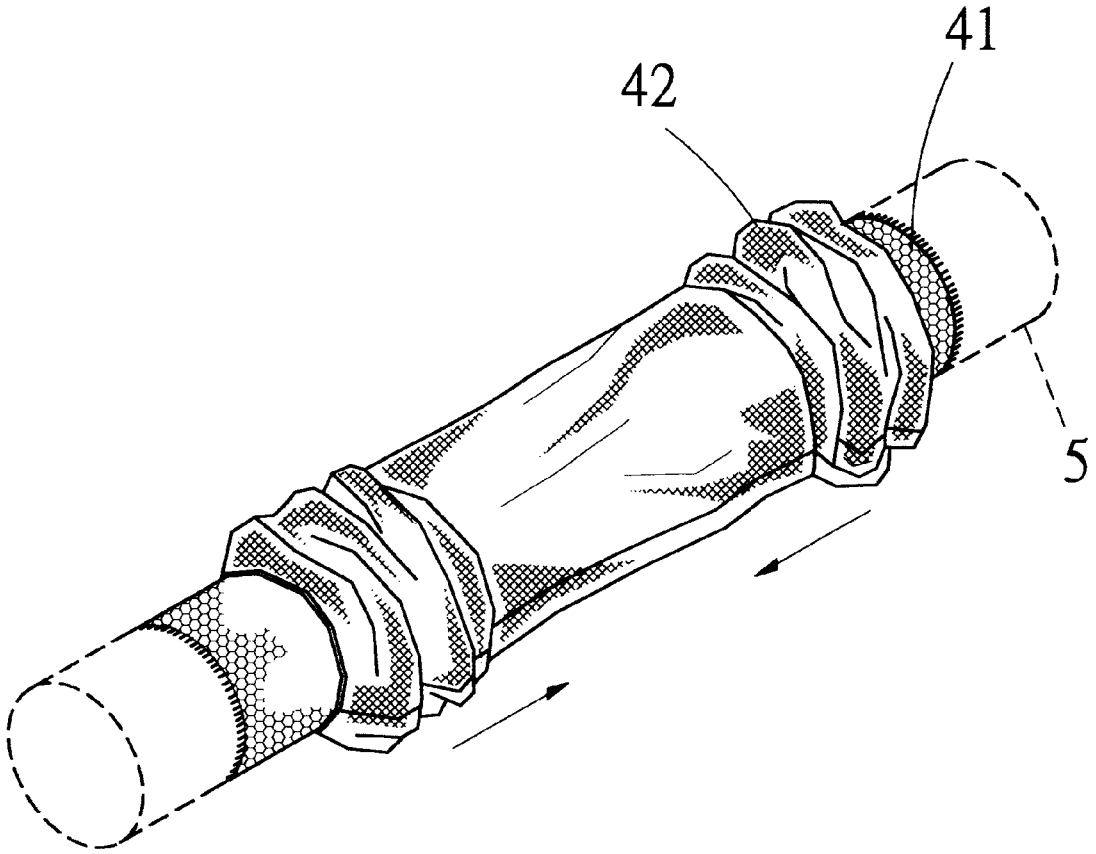
Figure 6:
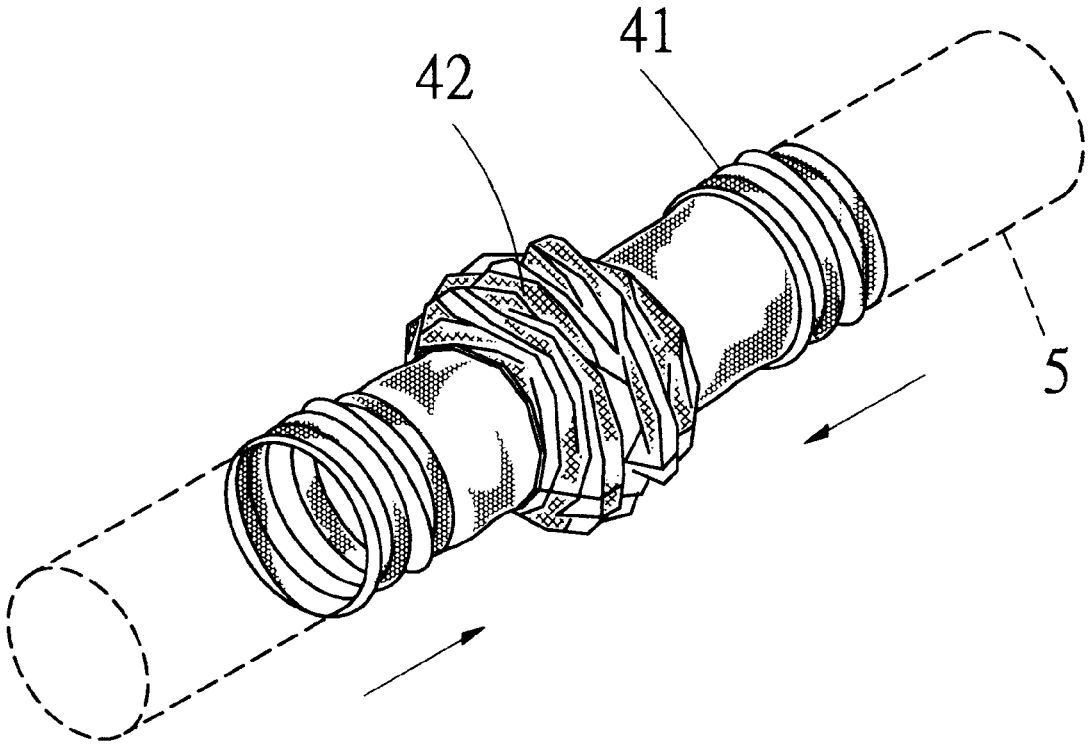
Figure 7:
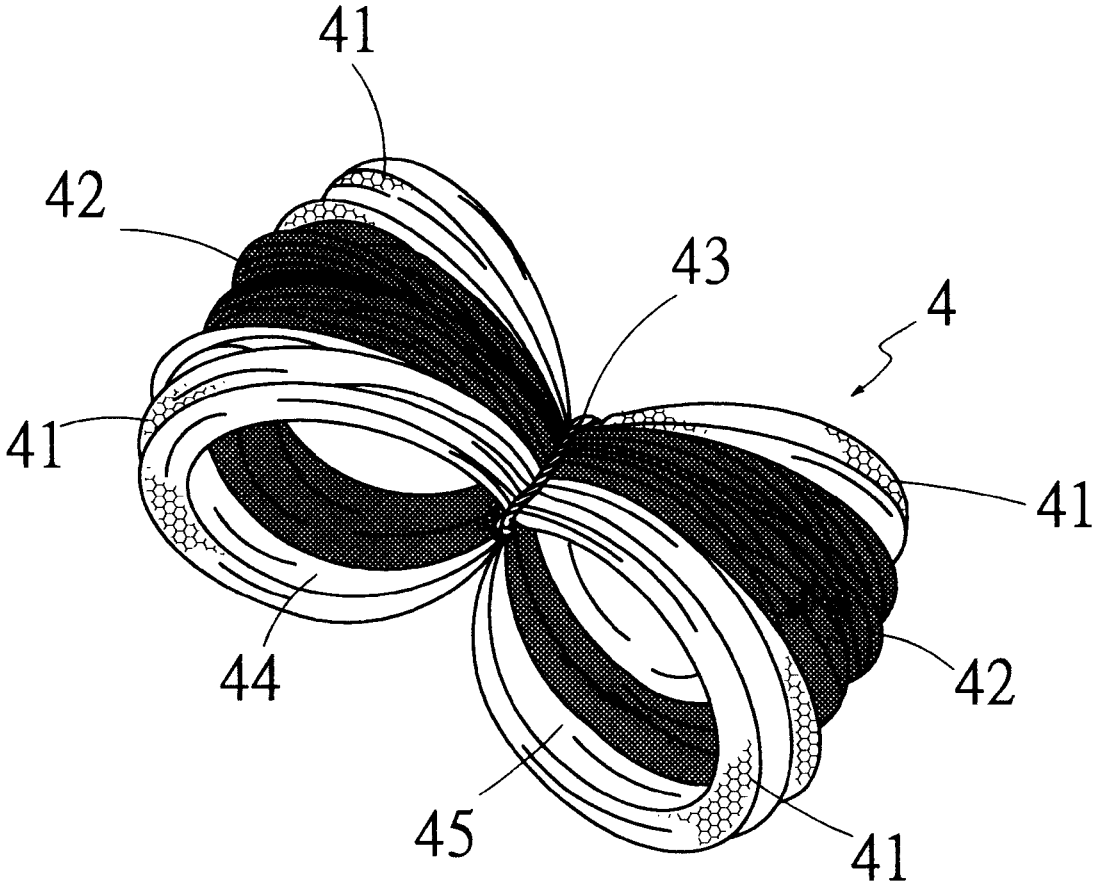

Please refer to FIG. 2 in which a ruffled cleaning device made according to the method of the present invention is shown. The ruffled cleaning device mainly includes an inner ring 3 and a bow-shaped ruffled body 4. Steps included in the method of the present invention for forming the inner ring 3 and the bow-shaped ruffled body 4, as well as for connecting these two parts to form a complete ruffled cleaning device shall be described in details as follows:

Steps for Forming the Bow-shaped Ruffled Body 4:

a. Making two long sleeves of elastic nets 41, 42 woven out of two types of materials having different degrees of surface coarseness, as shown in FIG. 3. The two types of materials may be, for example, artificial fibers and nylon filaments;

b. Sequentially putting the two long sleeves of elastic nets 41, 42 around a bar-like mold 5 to form two layers on the mold 5, as shown in FIG. 4;

c. Axially compressing the net 42 at outer layer from two ends toward a middle portion thereof to produce ruffles along the mold 5, as shown in FIG. 5;

d. Axially compressing the net 41 at inner layer from two ends toward a middle portion thereof, so that ruffles are produced to locate at two outer ends of the ruffled net 42, as shown in FIG. 6; and e. Removing the two ruffled layers from the mold 5 and using fastening means 43 to tighten a middle portion thereof so that a bow-shaped ruffled body 4 having two through holes 44, 45 is formed, as shown in FIG. 7.

It is understood the long sleeves of elastic nets for forming the ruffled body 4 are not limited to two layers. Three or four or more layers of elastic nets made of two or more materials can be used, so that the ruffled body 4 has densely arranged ruffles and provides more than two different degrees of surface coarseness suitable for cleaning different body areas.

Figure 8:
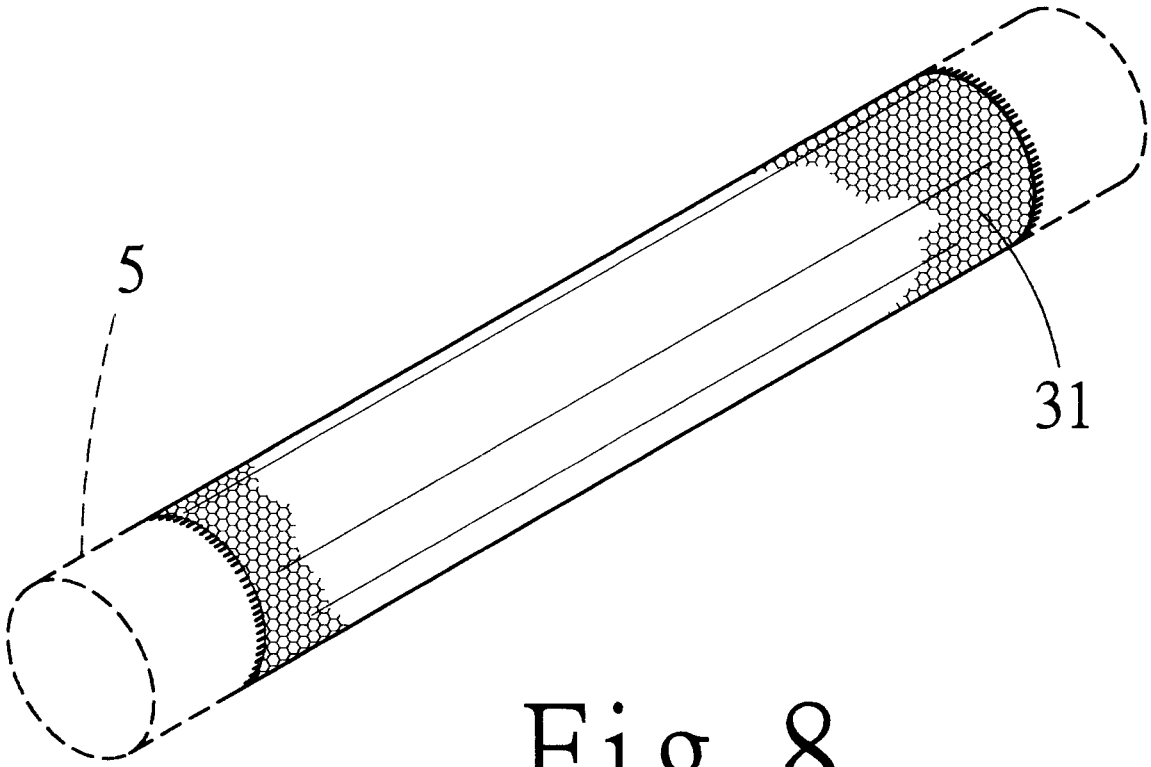
FIGS. 8 to 10 illustrate steps of the method of the present invention to form an inner ring of the ruffled cleaning device of FIG. 2.
Figure 9:
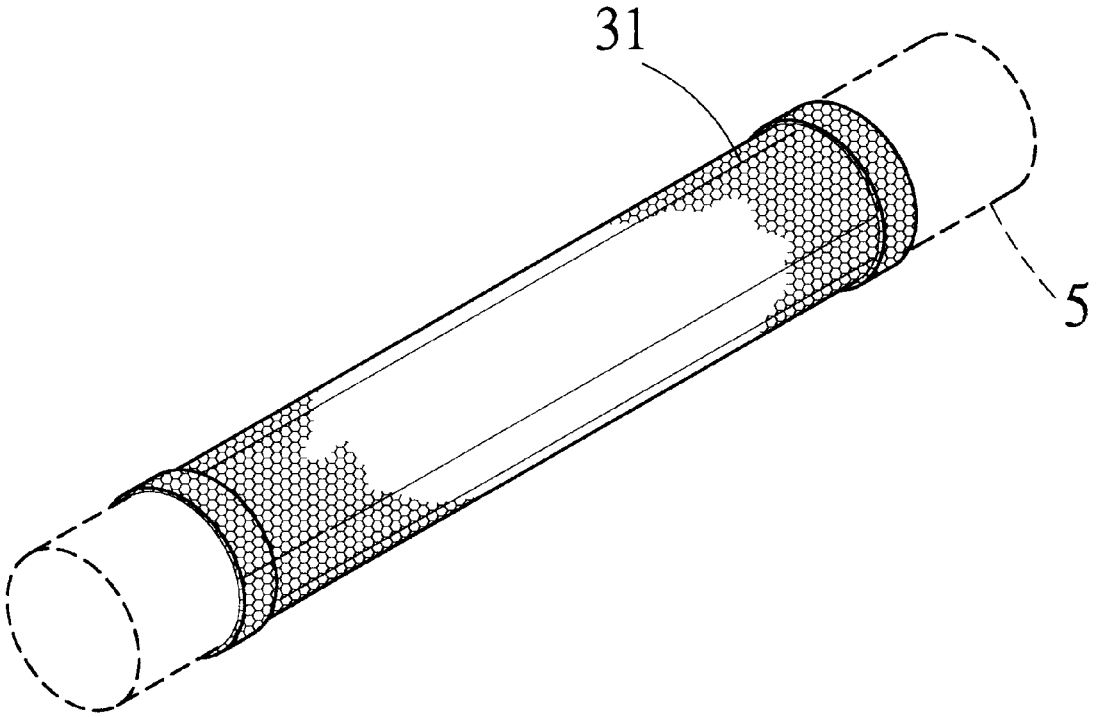
Figure 10:
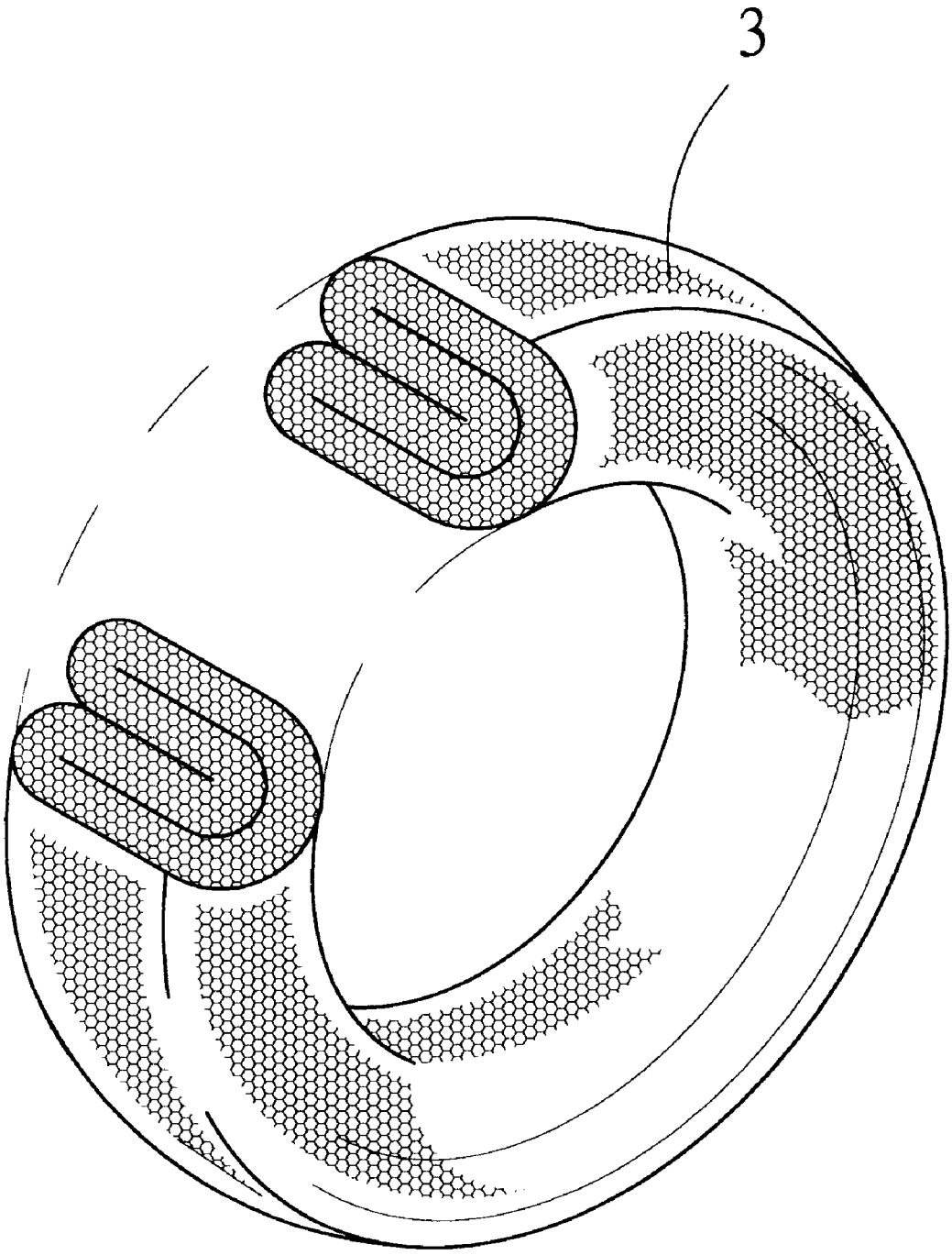

Steps for Forming the Inner Ring 3:

a. Making a long sleeve of elastic net 31 woven out of artificial fibers and putting it around a bar-like mold 5, as shown in FIG. 8;

b. Continuously turning over two ends of the elastic net 31 toward a middle portion thereof, as shown in FIG. 9, until a ring 3 is formed, as shown in FIG. 10; and c. Removing the ring 3 from the mold 5 and radially flattening it into a double-layer strip, as can be seen from FIG. 11.

Figure 11:
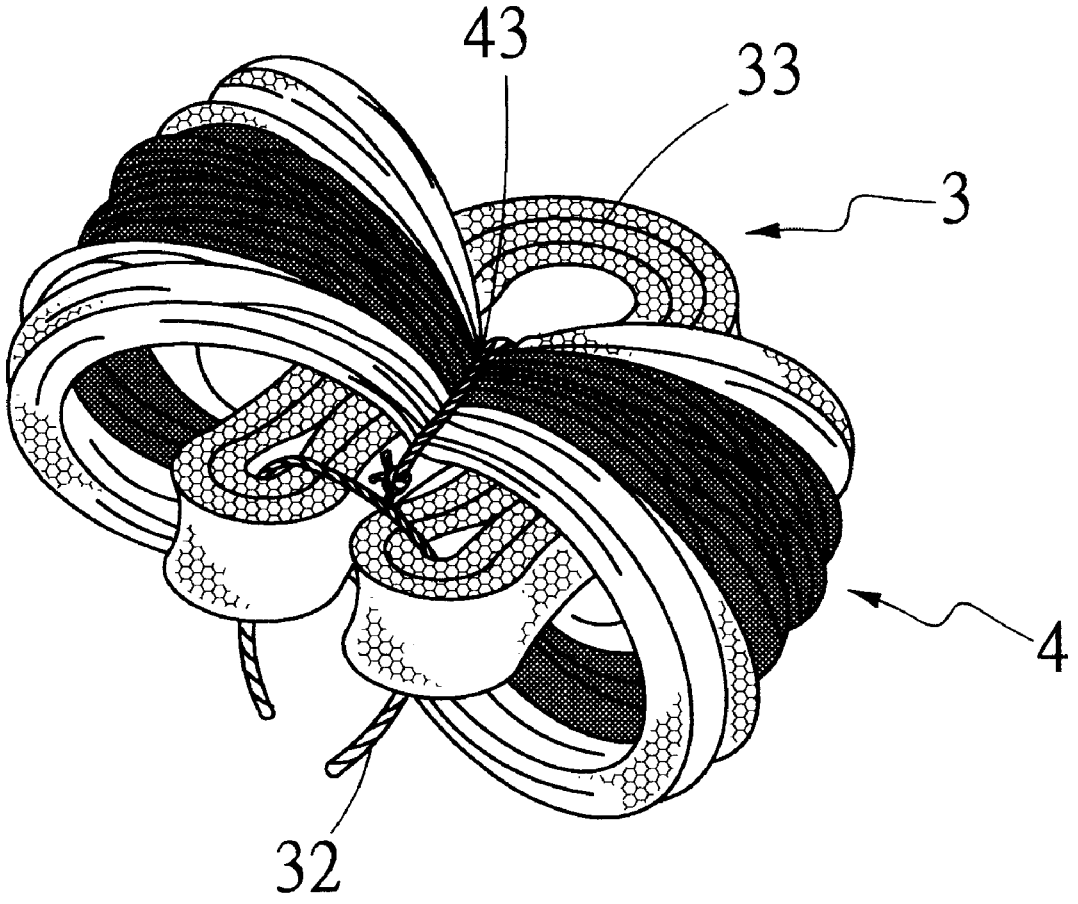
FIG. 11 illustrates the manner in which the inner ring and the bow-shaped ruffled body are connected together to form a complete ruffled cleaning device of FIG. 2.

Steps for Connecting the Inner Ring 3 to the Bow-shaped Ruffled Body 4:

a. Separately threading two ends of the strip formed from the flattened inner ring 3 through the two holes 44, 45 of the bow-shaped ruffled body 4 and firmly tying the two ends of the strip together by fastening means 32, as shown in FIG. 11; and b. Pulling the inner ring 3 at a potion 33 opposite to the two tightened ends, so that the tightened middle portion of the bow-shaped ruffled body 4 is compressed and an outer periphery of the ruffled body 4 naturally loosely spreads apart to form a scrubbing portion 46 with dense ruffles, as shown in FIG. 2.

To use the ruffled cleaning device made from the above steps, simply extend one hand through a space defined by the flattened inner ring 3 between the portion 33 and the ruffled body 4. And, a bar of soap may be selectively disposed between the fastening means 43 of the bow-shaped ruffled body 4 and the portion 33 of the inner ring 3.

Following are some advantages provided by the method of the present invention:

1. The bow-shaped ruffled body has denser ruffles and can therefore provide better elasticity and massage effect. The bow-shaped ruffled body also allows increased contact area with skin and gains access to deep recesses on the user's body to achieve thorough cleaning.

2. The bow-shaped ruffled body is more stably connected to the inner ring without moving irregularly relative to the inner ring when the whole ruffled cleaning device is used to wash and clean the user's body. That is, the ruffled cleaning device made by the method of the present invention can be more conveniently handled.

3. The bow-shaped ruffled body is formed from at least two layers of elastic nets that produces denser ruffles and can therefore hold more bubbles. The at least two layers of elastic nets may have different surface coarseness for separately cleaning different body areas according to actual need.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. A method of forming a ruffled cleaning device having a ruffled body connected to an inner ring, comprising following steps:

making a first long sleeve-shaped elastic net and putting it around a bar-like mold;

continuously turning over two ends of said first elastic net toward a middle portion thereof until it is in a shape of a ring for use as said inner ring of said ruffled cleaning device;

removing said first elastic net in ring shape from the mold and radially flattening it into a double-layer strip;

making more than one second long sleeve-shaped elastic net;

sequentially putting said more than one second elastic net around a bar-like mold to form more than one layer on the mold;

axially compressing said more than one second elastic net layer by layer from two ends toward a middle portion thereof to produce ruffles along the mold;

removing said more than one second net in ruffled form from the mold and tightening a middle point thereof with fastening means so that a bow-shaped ruffled body having two through holes is formed; separately threading two ends of said strip formed from said flattened ring-shaped first elastic net through said two through holes of said bow-shaped ruffled body and firmly tying said two ends of said strip together by fastening means; and pulling said inner ring at a point and compressing said bow-shaped ruffled body against said inner ring, so that an outer periphery of said ruffled body naturally loosely spreads apart to form a scrubbing portion with dense ruffles.

2. A method of forming a ruffled cleaning device as claimed in claim 1, wherein said ruffled body is formed by ruffling at least two layers of said second elastic nets; an inner layer of said at least two layers of second elastic nets being axially compressed from two ends toward a middle portion thereof after an outer layer of said second elastic nets has been axially compressed to produce ruffles, so that ruffles of said inner layer locate at two outer ends of said ruffles produced from said outer layer.

3. A method of forming a ruffled cleaning device as claimed in claim 2, wherein said at least two layers of said second elastic nets have different degrees of surface coarseness.

4. A method of forming a ruffled cleaning device as claimed in claim 2, wherein said at least two layers of said second elastic nets are made of different materials.

* * * * *